US008196512B1

(12) United States Patent
Reynolds et al.

(10) Patent No.: US 8,196,512 B1
(45) Date of Patent: Jun. 12, 2012

(54) PLASTIC ENCAPSULATED ENERGETIC MATERIAL INITIATION DEVICE

(75) Inventors: Richard K. Reynolds, Calistoga, CA (US); Christopher J. Nance, Middletown, CA (US); Andrew F. Cunningham, Seattle, WA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 13/078,591

(22) Filed: Apr. 1, 2011

Related U.S. Application Data

(60) Continuation of application No. 12/785,751, filed on May 24, 2010, now Pat. No. 7,921,774, which is a division of application No. 12/468,957, filed on May 20, 2009, now Pat. No. 7,748,322, which is a division of application No. 10/829,970, filed on Apr. 22, 2004, now Pat. No. 7,690,303.

(51) Int. Cl.
*F42C 19/12* (2006.01)
*F42B 3/198* (2006.01)

(52) U.S. Cl. ..... 102/202.14; 102/202.7

(58) Field of Classification Search ..... 102/202.5, 102/202.14, 202.7
See application file for complete search history.

(56) References Cited

U.S. PATENT DOCUMENTS

| | | | | |
|---|---|---|---|---|
| 2,415,045 | A | | 1/1947 | Seavey |
| 3,909,567 | A | | 9/1975 | Delgendre et al. |
| 3,971,320 | A | | 7/1976 | Lee |
| 4,306,499 | A | * | 12/1981 | Holmes ..... 102/202.4 |
| 4,819,560 | A | | 4/1989 | Patz et al. |
| 4,831,933 | A | | 5/1989 | Nerheim et al. |
| 4,840,122 | A | | 6/1989 | Nerheim |
| 4,869,170 | A | | 9/1989 | Dahmberg et al. |
| 5,029,529 | A | * | 7/1991 | Mandigo et al. ..... 102/202.9 |
| 5,052,301 | A | | 10/1991 | Walker |
| 5,230,287 | A | | 7/1993 | Arrell, Jr. et al. |
| 5,370,053 | A | | 12/1994 | Williams et al. |
| 5,423,261 | A | * | 6/1995 | Bernardy et al. ..... 102/202.14 |
| 5,431,101 | A | | 7/1995 | Arrell, Jr. et al. |
| 5,433,147 | A | * | 7/1995 | Brede et al. ..... 102/202.2 |
| 5,495,806 | A | | 3/1996 | Willey |
| 5,531,473 | A | * | 7/1996 | Rink et al. ..... 280/737 |
| 5,641,997 | A | | 6/1997 | Ohta et al. |
| 5,654,521 | A | | 8/1997 | McDaniel |
| 5,912,428 | A | | 6/1999 | Patti |
| 5,929,368 | A | | 7/1999 | Ewick et al. |
| 5,969,286 | A | | 10/1999 | Ward et al. |
| 6,073,963 | A | | 6/2000 | Hamilton et al. |
| 6,079,332 | A | | 6/2000 | Marshall et al. |
| 6,129,955 | A | | 10/2000 | Papathomas et al. |
| 6,158,347 | A | | 12/2000 | Neyer et al. |

(Continued)

FOREIGN PATENT DOCUMENTS

JP 01248546 A 10/1989

*Primary Examiner* — Troy Chambers
(74) *Attorney, Agent, or Firm* — Harness, Dickey & Pierce, P.L.C.

(57) ABSTRACT

An initiator with a housing formed of plastic and a chip assembly for initiating at least one of a combustion event, a deflagration event and a detonation event. The chip assembly includes an electrically-actuated chip and a pair of electric leads that extend through the housing and are configured to couple the electrically-actuated chip to a fireset circuit. The electrically-actuated chip is partially encapsulated in the housing. A method for forming an initiator is also provided.

20 Claims, 16 Drawing Sheets

U.S. PATENT DOCUMENTS 6,227,115 B1 5/2001 Gruber et al.
6,255,728 B1 7/2001 Nasiri et al.
6,268,775 B1 7/2001 Patti
6,311,621 B1 11/2001 Marshall et al.
6,341,562 B1 1/2002 Brisighella
6,363,828 B1 * 4/2002 Sherlock et al. ..... 89/1.13
6,408,759 B1 6/2002 Ewick et al.
6,463,857 B1 10/2002 Schmid et al.
6,467,414 B1 10/2002 Fisher
6,578,486 B2 6/2003 Mattes et al.
6,591,754 B1 7/2003 Baur et al.
6,601,514 B1 8/2003 Bretfeld et al.
6,634,299 B2 * 10/2003 Vetter et al. ..... 102/288
6,644,197 B2 11/2003 Goernig et al.
6,659,010 B2 12/2003 Goernig et al.
6,718,884 B1 4/2004 Yabuta et al.
6,732,655 B1 5/2004 Jakob et al.
6,739,264 B1 5/2004 Hosey et al.
6,752,083 B1 * 6/2004 Lerche et al. ..... 102/202.7
6,753,922 B1 6/2004 Sengupta et al.
6,915,744 B2 7/2005 Tirmizi
6,923,122 B2 8/2005 Hennings et al.
7,007,973 B2 3/2006 Canterberry et al.
7,111,558 B2 9/2006 Brede et al.
7,430,963 B2 10/2008 Hennings et al.
7,543,532 B2 6/2009 Nance
7,552,680 B2 6/2009 Nance et al.
7,571,679 B2 8/2009 Nance
7,581,496 B2 9/2009 Hennings et al.
7,661,362 B2 2/2010 Hennings et al.
7,690,303 B2 4/2010 Reynolds et al.
2002/0023567 A1 * 2/2002 Riviere et al. ..... 102/202.5
2002/0062757 A1 * 5/2002 Vetter ..... 102/530
2002/0073872 A1 * 6/2002 Enzmann et al. ..... 102/530
2002/0079030 A1 6/2002 Chan et al.
2003/0183110 A1 * 10/2003 Brede et al. ..... 102/202.14

* cited by examiner

PLASTIC ENCAPSULATED ENERGETIC MATERIAL INITIATION DEVICE

This application is a continuation of U.S. patent application Ser. No. 12/785,751 filed May 24, 2010, which is a division of U.S. patent application Ser. No. 12/468,957, filed May 20, 2009, issued as U.S. Pat. No. 7,748,322 on Jul. 6, 2010, which is a division of U.S. patent application Ser. No. 10/829,970 filed Apr. 22, 2004, issued as U.S. Pat. No. 7,690, 303 on Apr. 6, 2010, the disclosures of which are hereby incorporated by reference as if fully set forth in detail herein.

INTRODUCTION

The present invention generally relates to devices for initiating combustion, deflagration and detonation events.

Modern initiators, such as detonators, commonly employ materials including ceramics and stainless steels in their construction. These materials are typically selected to provide the initiator with a degree of robustness that permits the initiator to withstand extreme changes in temperature and humidity, as well as to resist oxidization. While modern initiator configurations are generally satisfactory for their intended purposes, they are nonetheless susceptible to improvement.

For example, many of these initiators, particularly those that employ exploding foil initiators, are relatively difficult and labor-intensive to fabricate. Consequently, they are relatively expensive and are not employed in many applications due to considerations for cost.

As another example, the ceramic and stainless steel materials that are employed in the construction of many detonator-type initiators are more dense than the explosive charge that surrounds the detonator-type initiator. Where an explosive is detonated by a single detonator-type initiator, perturbations in the wave front that result from differences between the density of the explosive charge and the densities of the components of the detonator-type initiator are generally not of significant concern. In situations where several detonator-type initiators are passively employed to detonate an explosive charge, however, it is highly desirable that the detonation wave front that passes through the detonators and the explosive charge propagate with little or no perturbations in the wave front to thereby achieve maximum efficiency. Consequently, configurations employing multiple conventionally-configured detonator-type initiators do not provide maximum efficiency as the densities of the materials that are used in their construction are significantly different than that of the secondary explosive that is typically employed in a main explosive charge so that significant perturbations in the wave front are generated as the wave front passes through the detonator-type initiator and into (or back into) the main explosive charge.

Accordingly, there remains a need in the art for an improved initiator.

SUMMARY

In one form, the present teachings provide an initiator with a housing formed of plastic and a chip assembly for initiating at least one of a combustion event, a deflagration event and a detonation event. The chip assembly includes an electrically-actuated chip and a pair of electric leads that extend through the housing and are adapted to couple the electrically-actuated chip to a fireset circuit. The electrically-actuated chip is partially encapsulated in the housing.

In another form, the present invention provides an explosive device with an explosive charge that is formed of an energetic material and a detonator that is embedded into the explosive charge. The detonator includes a housing, which is formed of a plastic material, and an explosive pellet that is housed in the housing.

In yet another form, the present invention provides an initiator chip assembly with an electrically-actuated chip and a pair of contacts. The electrically-actuated chip is configured to initiate at least one of a combustion event, a deflagration event, and a detonation event in a material that is positioned in intimate contact with the electrically-actuated chip and includes a pair of terminals. Each of the electrical contacts includes a base portion and at least one deflectable spring arm that has a first end, which is soldered to an associated one of the terminals, and a second end that is coupled to the base portion. The spring arms resiliently couple the electrically-actuated chip to the base portions.

In a further form, the present invention provides a method of forming an initiator that includes: providing a lead frame having a pair of contacts; securing an electrically-actuated chip to the pair of contacts such that a first terminal on the electrically-actuated chip is electrically coupled to a first one of the pair of contacts and a second terminal on the electrically-actuated chip is electrically coupled to a second one of the pair of contacts, the electrically-actuated chip being configured to initiate at least one of a combustion event, a deflagration event and a detonation event; inserting the lead frame into a mold such that the electrically-actuated chip is disposed in mold cavity; and injecting a plastic into the mold to form a housing in which at least a portion of the electrically-actuated chip is encapsulated.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
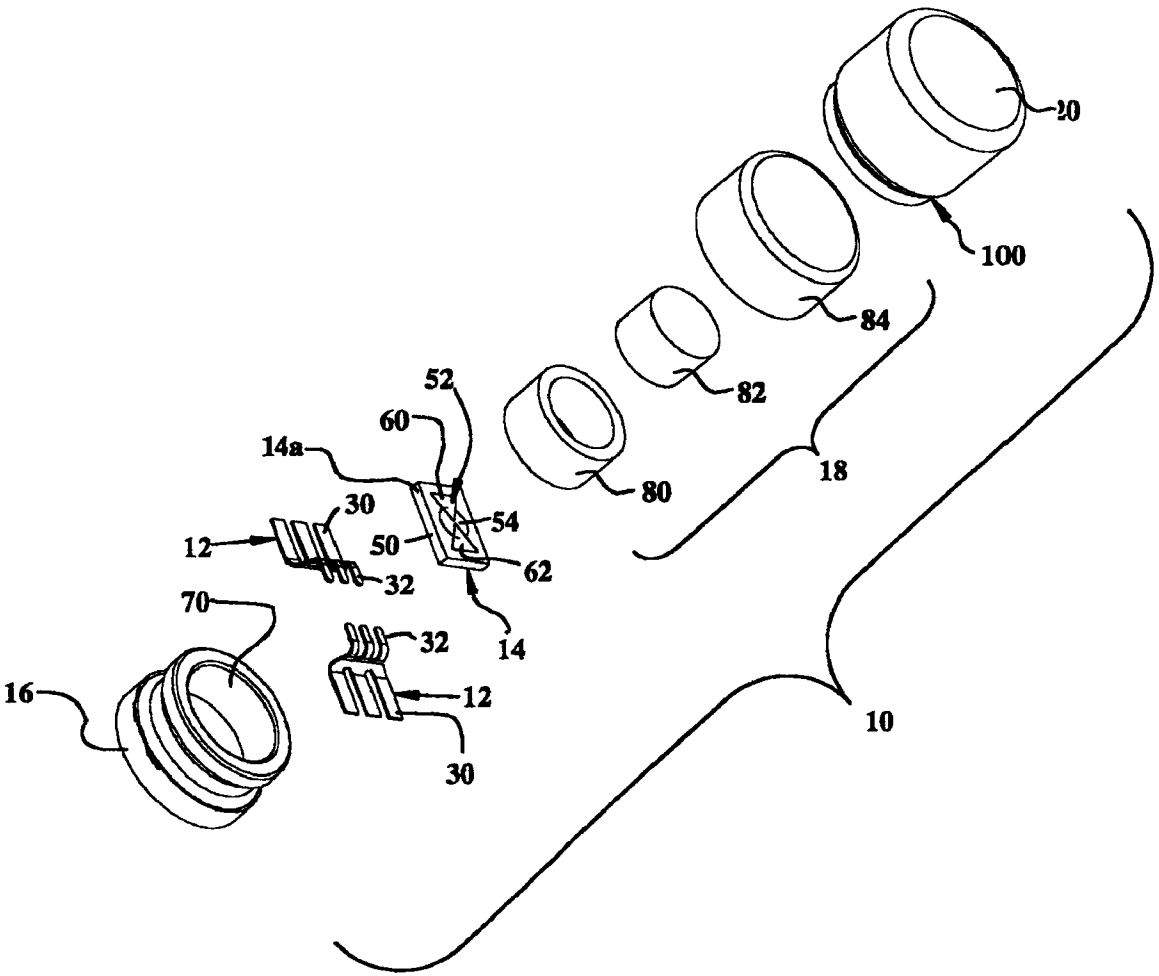
FIG. 1 is an exploded perspective view of an initiator constructed in accordance with the teachings of the present invention.
Figure 2:
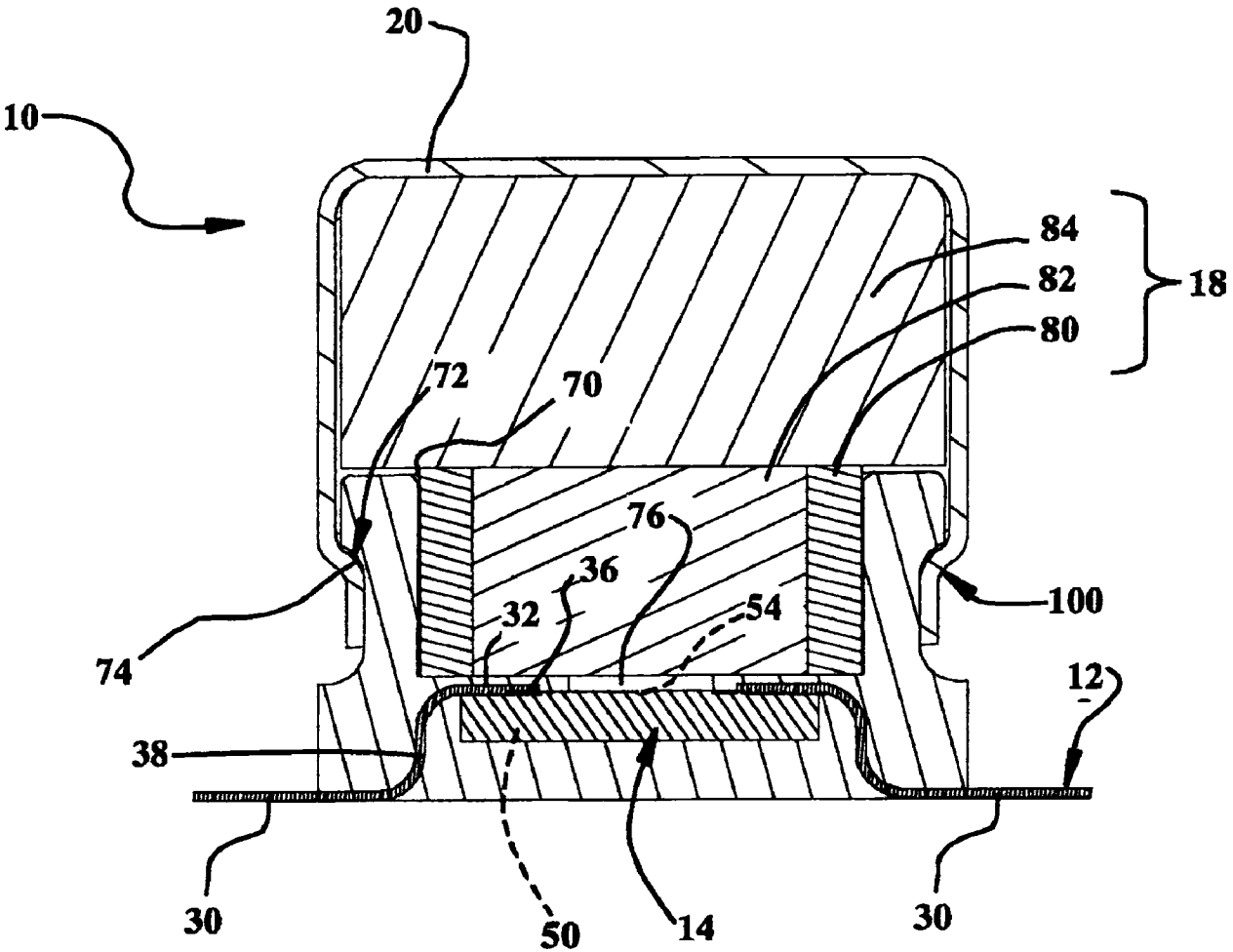
FIG. 2 is a longitudinal section view of the initiator of FIG. 1.

With reference to FIGS. 1 and 2 of the drawings, an initiator constructed in accordance with the teachings of the present invention is generally indicated by reference numeral 10. While the initiator 10 is illustrated as being a detonator-type initiator, the initiator 10 may be any type of initiator and may be configured to initiate a combustion event, a deflagration event and/or a detonation event. The initiator 10 may include a plurality of electrical contacts 12, an initiator chip 14, a housing 16, a pellet assembly 18.

Figure 3:
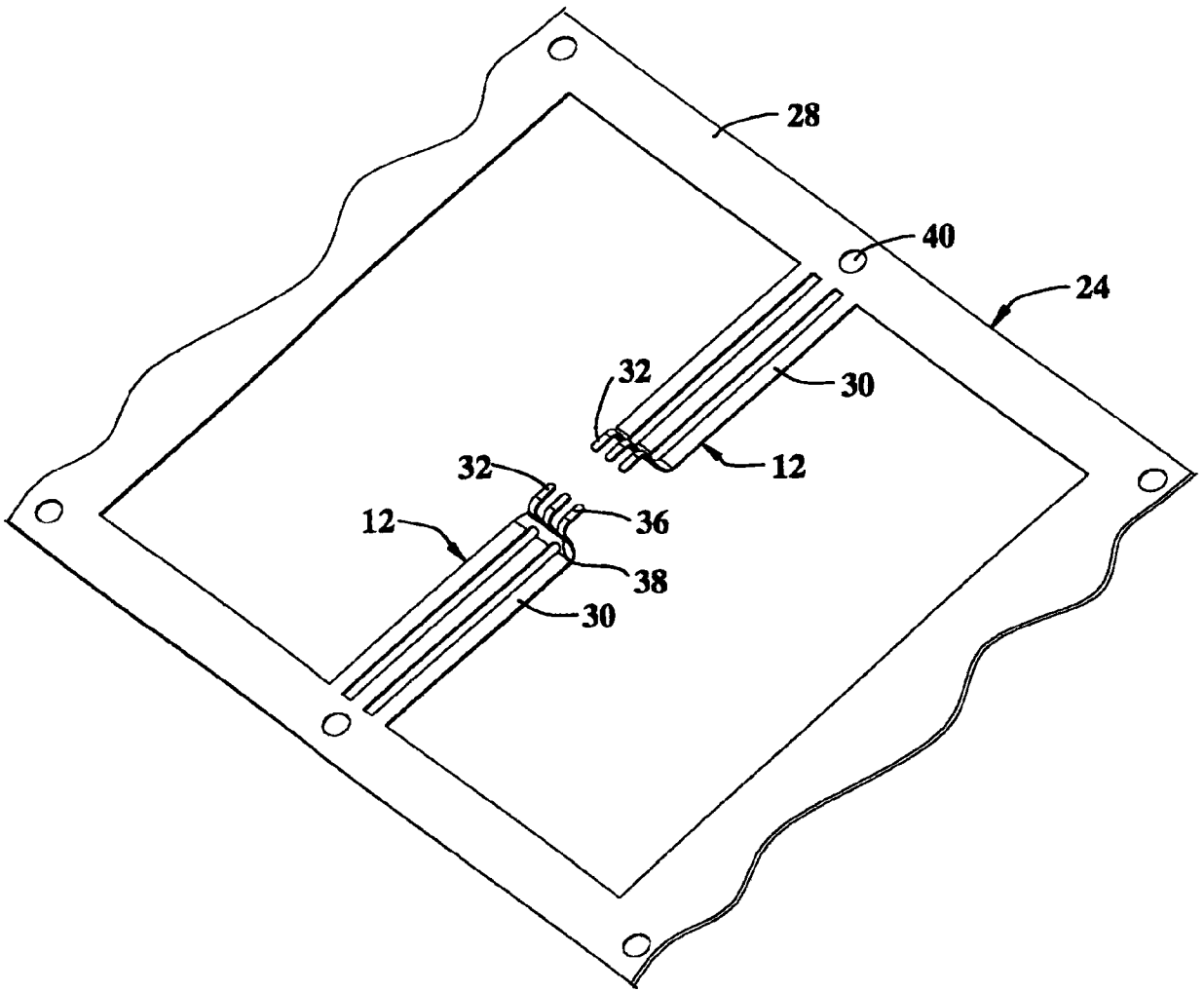
FIG. 3 is a perspective view of a portion of the initiator of FIG. 1 illustrating the lead frame in greater detail.

With additional reference to FIG. 3, the electrical contacts 12 may be formed as a portion of a lead frame 24. The lead frame 24 may be configured to support the initiator chip 14 during the fabrication of the initiator 10 and may be formed from any appropriate material. In the particular example provided, the initiator chip 14 is electronically-actuated and as such, the lead frame 24 may be fully or partially formed of an electrically conductive material, such as an iron, nickel and cobalt alloy that is allowed per ASTM F15, a copper material, such as beryllium copper or gold-plated beryllium copper.

The lead frame 24 may include a frame structure 28 to which the electrical contacts 12 are coupled and extend inwardly from. Each of the electrical contacts 12 may include a base portion 30 and one or more deflectable spring arms 32. Each of the spring arms 32 may include a first, distal end 36 and a second, proximal end 38 that is coupled to an associated base portion 30. The spring arms 32 may terminate in a plane that is parallel to and spaced apart from a plane in which the base portions 30 are disposed. In the example provided, the first end 36 of each spring arm 32 is reflexed toward an associated base portion 30. The spring arms 32 may merge with one or more other spring arms 32 prior to intersecting an associated base portion 30.

In the example provided, the lead frame 24 is formed in a progressive die (not shown) such that a plurality of locating apertures 40 are pierced through the frame structure 28, the electrical contacts 12 are blanked and the spring arms 32 are formed. Although the lead frame 24 is illustrated as being a singularly formed article, those of ordinary skill in the art will appreciate from this disclosure that the lead frame 24 may be fabricated so that a plurality of the lead frames 24 may be joined to one another (e.g., in a progressive-type die that does not sever the individual lead frames 24).

Returning to FIGS. 1 and 2, the initiator chip 14 may be any type of chip-like device for initiating a combustion event, a deflagration event, an explosion event or a detonation event and may be electronically-actuated or passively activated. Examples of suitable chip-like devices may include exploding foil initiators, exploding bridge wire initiators, squibs, SCB semi-conductor bridge devices and thin film bridge initiators. In the example provided, the initiator chip 14 is a type of exploding foil initiator 14*a* that includes a substrate 50, a bridge 52 and a flyer 54. The substrate 50 may be formed of a ceramic material and serves as a base upon which the bridge 52 and the flyer 54 are disposed. The bridge 52 is disposed between the substrate 50 and the flyer 54 and includes with first and second contacts 60 and 62. As exploding foil initiators are generally well known in the art, a detailed discussion of their construction and operation need not be provided herein. While the exploding foil initiator 14*a* may optionally include a barrel (not shown), i.e., a discrete layer that is disposed about the flyer 54 with a hole through which the flyer 54 is launched upon activation of the exploding foil initiator 14*a*, the initiator chip 14 in the example provided does not include a conventional barrel. Rather, the barrel may be formed by the housing 16, as will be described in detail, below.

Figure 4:
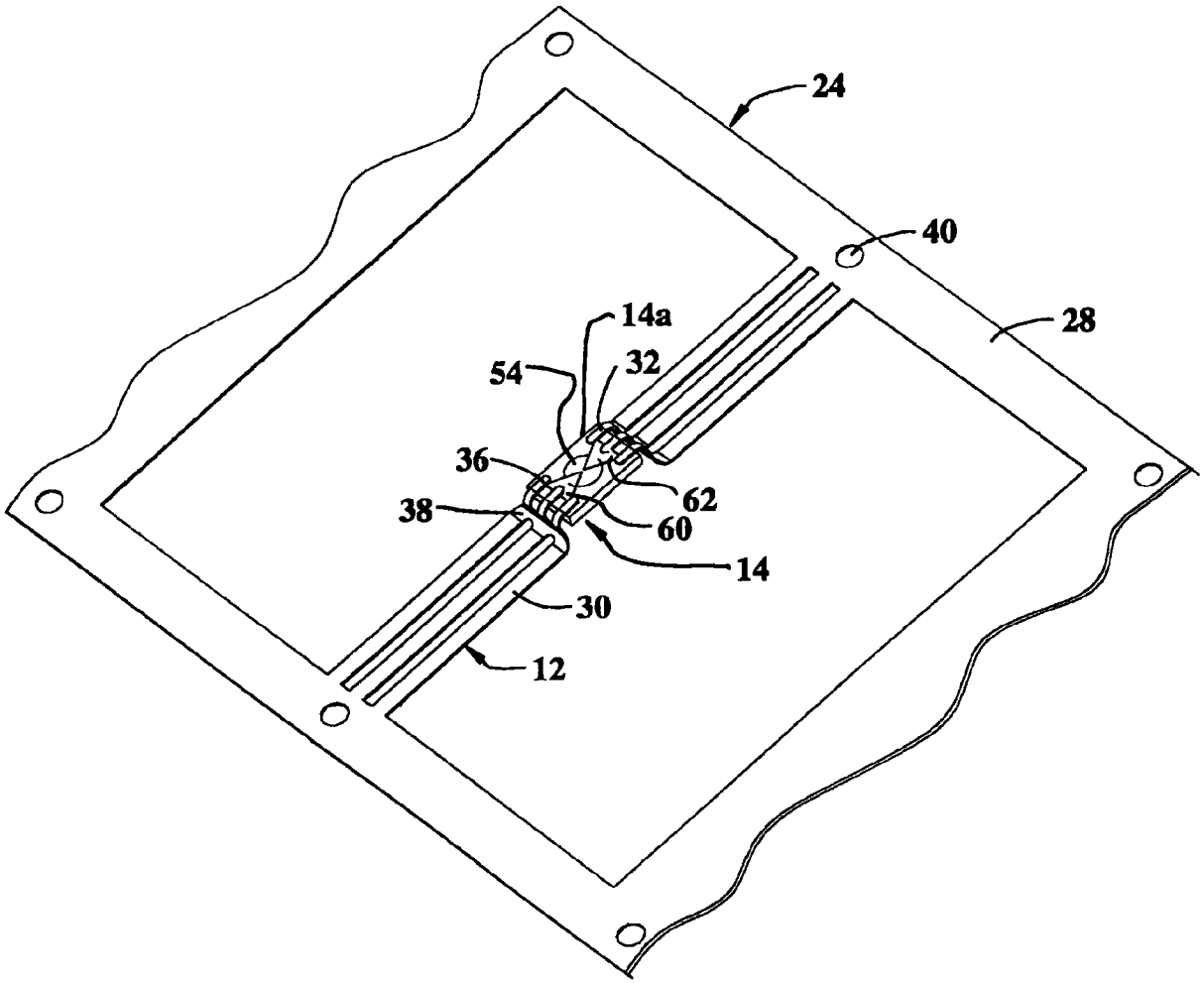
FIG. 4 is a perspective view illustrating the lead frame coupled to an initiator chip.

With reference to FIG. 4, the spring arms 32 may be electrically coupled to the first and second contacts 60 and 62 of the bridge 52 on the exploding foil initiator 14*a*. In the example provided, the spring arms 32 are soldered to the first and second contacts 60 and 62, but other coupling means, such as adhesives, may be additionally or alternatively employed. Thus coupled, the spring arms 32 resiliently couple the initiator chip 14 to the base portions 30 of the electrical contacts 12. As each spring arm 32 has a reflexed configuration in the example provided, the initiator chip 14 is elevated above the base portions 30. Those of ordinary skill in the art will appreciate in view of this disclosure that the lead frame 24 or portions thereof may be formed with features (not shown) that provide additional support to the initiator chip 14 during the fabrication of the initiator 10 and/or help to precisely locate (i.e., register) the initiator chip 14 relative to the spring arms 32.

Returning to FIG. 2, the housing 16 may be unitarily formed of a plastic material, such as polycarbonate, acrylic or ABS. The plastic material may be selected on the basis of its material characteristics, such as strength, density and/or coefficient of thermal expansion. For example, where the initiator 10 may be exposed to a wide range of temperatures, the plastic material may be selected such that its coefficient of thermal expansion closely matches that of the substrate 50 of the initiator chip 14. The plastic material may be a transparent (e.g., clear transparent) material that permits the contents of the housing 16 to be visually inspected after the initiator 10 has been assembled. The housing 16 may be formed to fully or partially encapsulate the initiator chip 14 and may include a cavity 70 for at least partially housing the pellet assembly 18, and an attachment feature 72. The attachment feature 72 may be any feature that is formed into or onto the housing 16 that facilitates that coupling of the cover 20 to the housing 16 and may include a flange 74 that is formed about the circumference of the housing 16. In the example provided, the housing 16 also defines a barrel 76 that is disposed between the initiator chip 14 and the cavity 70.

As the barrel 76 is defined by the tooling that is employed to fabricate the housing 16 and as the tooling may position the initiator chip 14 in a predetermined manner, we have found that securing the initiator chip 14 to the housing 16 via encapsulation and integrally forming the barrel 76 with the housing 16 permits the flyer 54 to be positioned relative to (i.e., spaced apart from) the pellet assembly 18 with improved accuracy and reliability.

For other known exploding foil initiators (EFI), the amount of energy that was supplied to the EFI to initiate its actuation was increased to compensate for the variance in the positioning of a flyer relative to a charge of energetic material. Essentially, the amount of energy that was supplied to an EFI to initiate its activation was based on a worst-case scenario wherein the flyer and the energetic material were spaced apart by a maximum permissible distance. The formation of the housing 16 an integrally-formed barrel 76 as detailed herein permits the flyer 54 to be more accurately and reliably positioned relative to the pellet assembly 18 so that a reduction of up to 75% in the tolerance that is associated with the dimension by which the flyer and the pellet assembly are spaced apart is possible. This reduction in the tolerance significantly improves the worst-case scenario, so that initiators constructed in accordance with the teachings of the present invention may be reliably activated with less electrical energy.

The pellet assembly 18 may include a structural sleeve 80, a first pellet 82 and a second pellet 84. The structural sleeve 80 may be employed to structurally support the first pellet 82 during its fabrication and/or initiation and may be formed of a suitable material, such as 6061 T6 anodized aluminum. The first pellet 82 may be pressed into the structural sleeve 80 at pressures that may exceed 50,000 psi or more. In the example provided, the initiator 10 is configured to initiate a detonation event and as such, the first pellet 82 may be formed of a fine particle size secondary explosive, such as RSI-007, which may be obtained from Reynolds Systems, Inc. of Middletown, Calif., HNS-IV (hexanitrostilbene), PETN (pentaerithrytol tetranitrate) or NONA (nonanitroterphenyl), while the second pellet 84 may be formed of a suitable energetic material that may be tailored to a specific situation in a manner that is within the capabilities of one of ordinary skill in the art.

Figure 5:
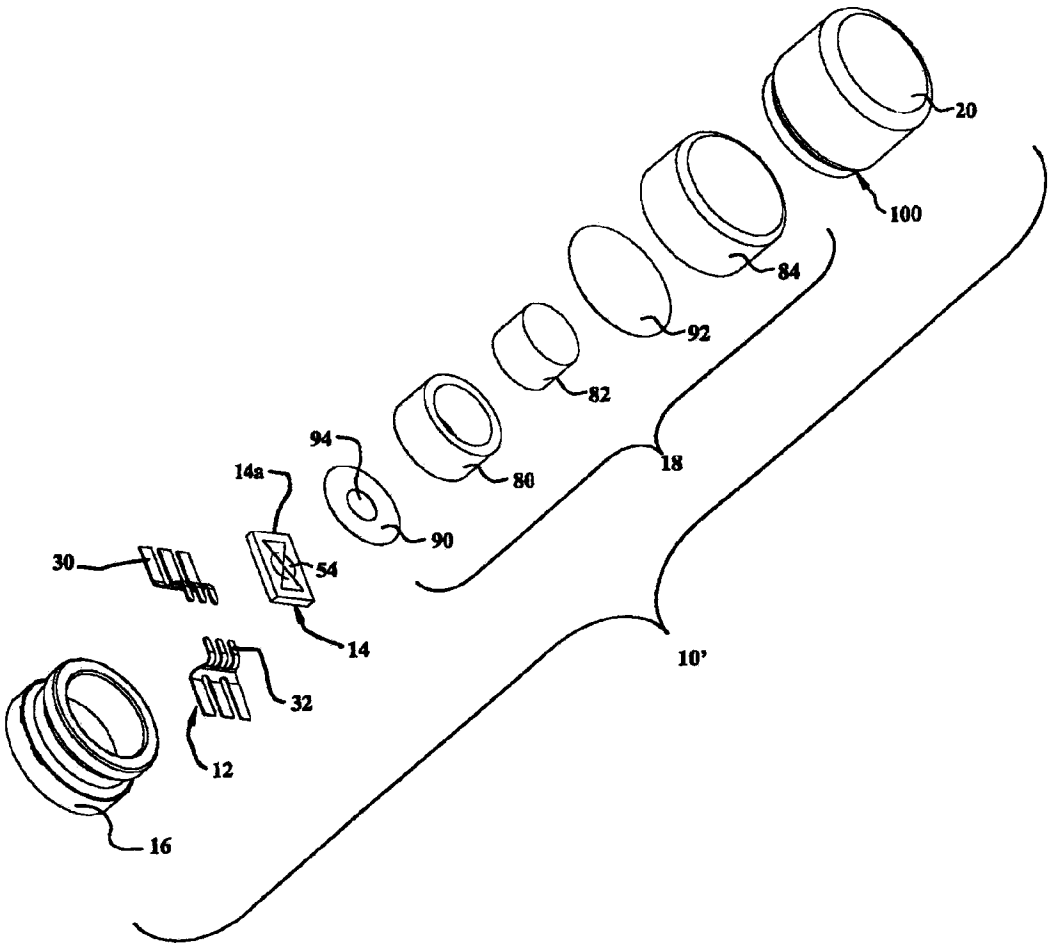
FIG. 5 is an exploded perspective view similar to FIG. 1 but illustrating another initiator constructed in accordance with the teachings of the present invention.
Figure 6:
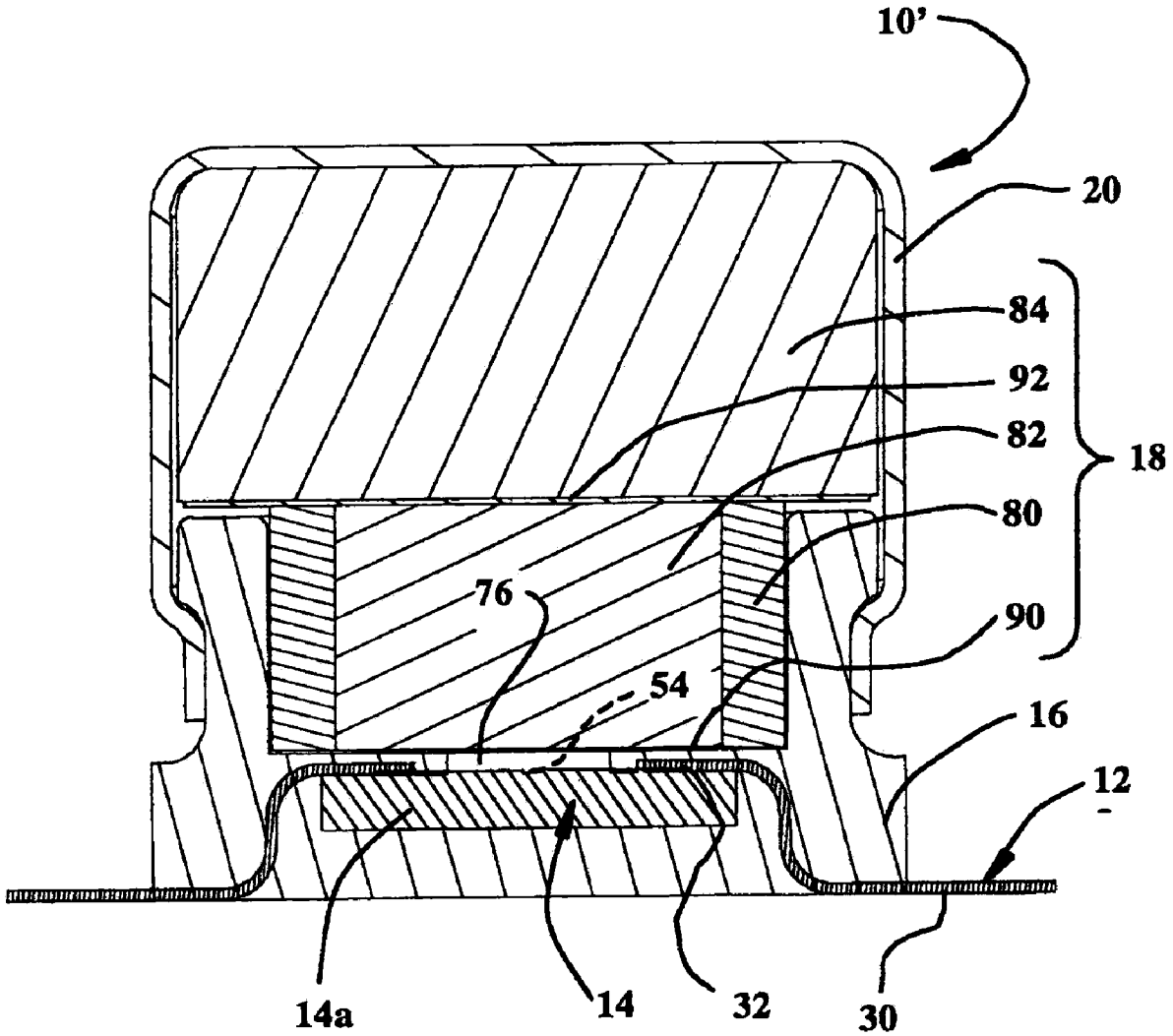
FIG. 6 is a longitudinal sectional view of the initiator of FIG. 5.

With reference to FIGS. 5 and 6, the pellet assembly 18 may also include a first member 90, which is disposed between the initiator chip 14 and the structural sleeve 80, and a second member 92 that is disposed between the first and second pellets 82 and 84. The first member 90 may be an electrically-insulating material, such as polyamide, and may be relatively thin, such as about 0.001 inch in thickness. As the initiator 10' that is illustrated also employs an exploding foil initiator 14*a*, the first member 90 includes a hole 94 that permits the flyer 54 to travel through the barrel 76 and against the first pellet 82 when the initiator 10' is activated. Those of ordinary skill in the art will appreciate from this disclosure that the structural sleeve 80 may be formed of a structural insulating material to thereby eliminate any need for the first member 90.

The second member 92 may be a material, such as 0.002 inch thick aluminum, that forms a barrier between the first and second pellets 82 and 84 to inhibit the first and second pellets 82 and 84 from chemically reacting with one another. Additionally or alternatively, the second member 92 may be employed to enhance or attenuate the shock wave that is created by the combustion, deflagration or detonation of the first pellet 82, and/or to form a barrier that combusts in response to the combustion, deflagration or detonation of the first pellet 82 and thereby ignites the second pellet 84.

Returning to FIGS. 1 and 2, the cover 20 may be formed from an appropriate material, such as aluminum that conforms to ASTM B209-2 and/or QQ-A-250/2B. The cover 20 may be configured to close and environmentally seal the cavity 70 and/or to retain one or more of the components of the pellet assembly 18 in intimate contact with another component of the initiator 10 (e.g., the first pellet 82 in intimate contact with the barrel 76). In the example provided, a predetermined force is applied to the cover 20 to drive the cover 20 toward the pellet assembly 18 and a crimp 100 is formed in the cover 20 to fixedly couple the cover 20 to the housing 16. The crimp 100 may extend about the entire perimeter of the cover 20 and abut the flange 74 on the housing 16. Alternatively, the crimp 100 may be comprised of a series of circumferentially spaced-apart deformations. In the particular embodiment illustrated, the crimp 100 permits the cover 20 to engage the housing 16 so that the cavity 70 is environmentally sealed. Additionally or alternatively, sealants and/or seals may be employed to seal or aid in sealing the cover 20 to the housing 16. The cover 20 may also be employed to generate a secondary flyer 54 that may be propelled by the pellet assembly 18 to initiate a detonation event in a main charge (not shown).

Figure 7:
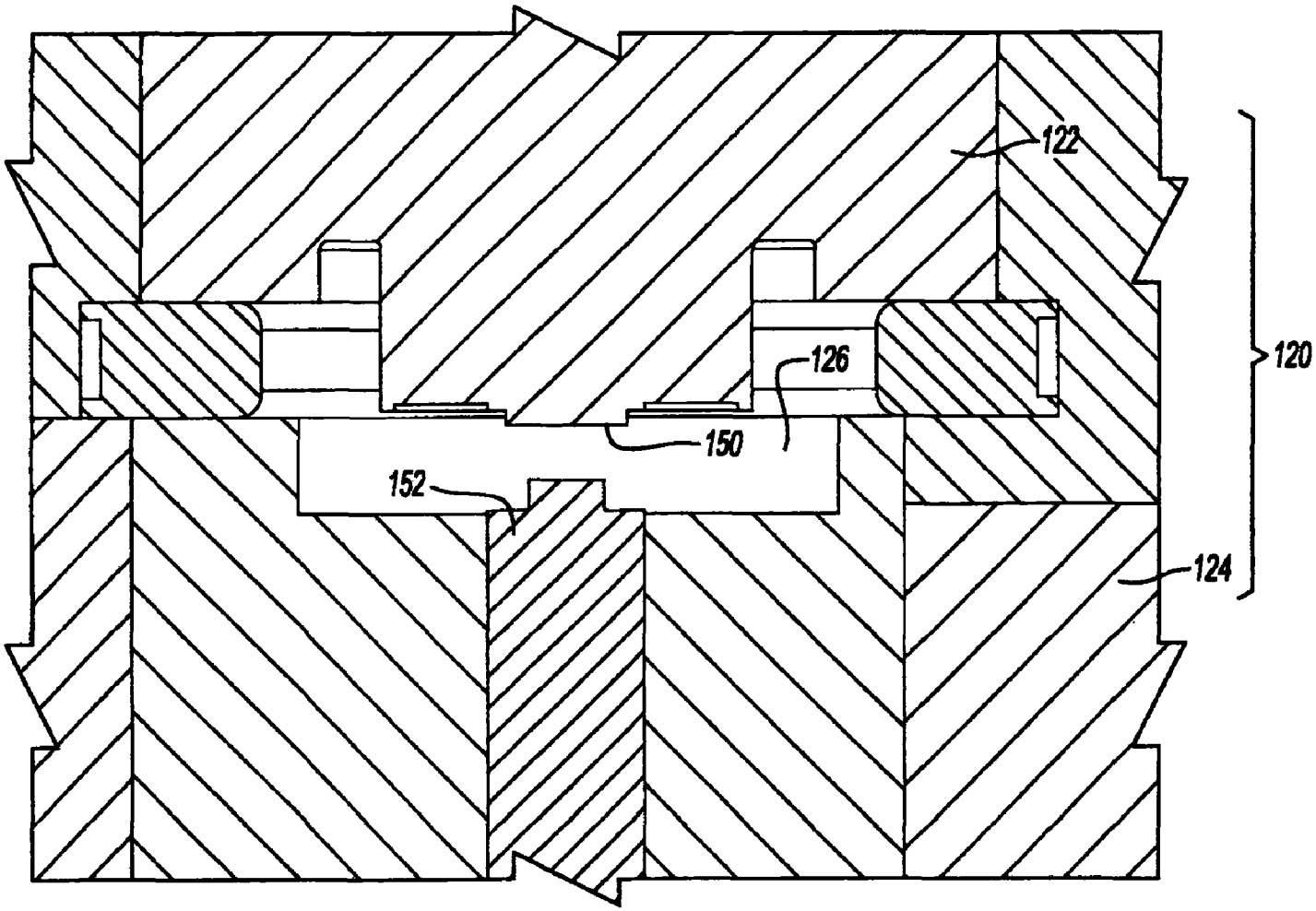
FIG. 7 is a sectional view of an exemplary mold for forming the initiator of FIG. 1.
Figure 8:
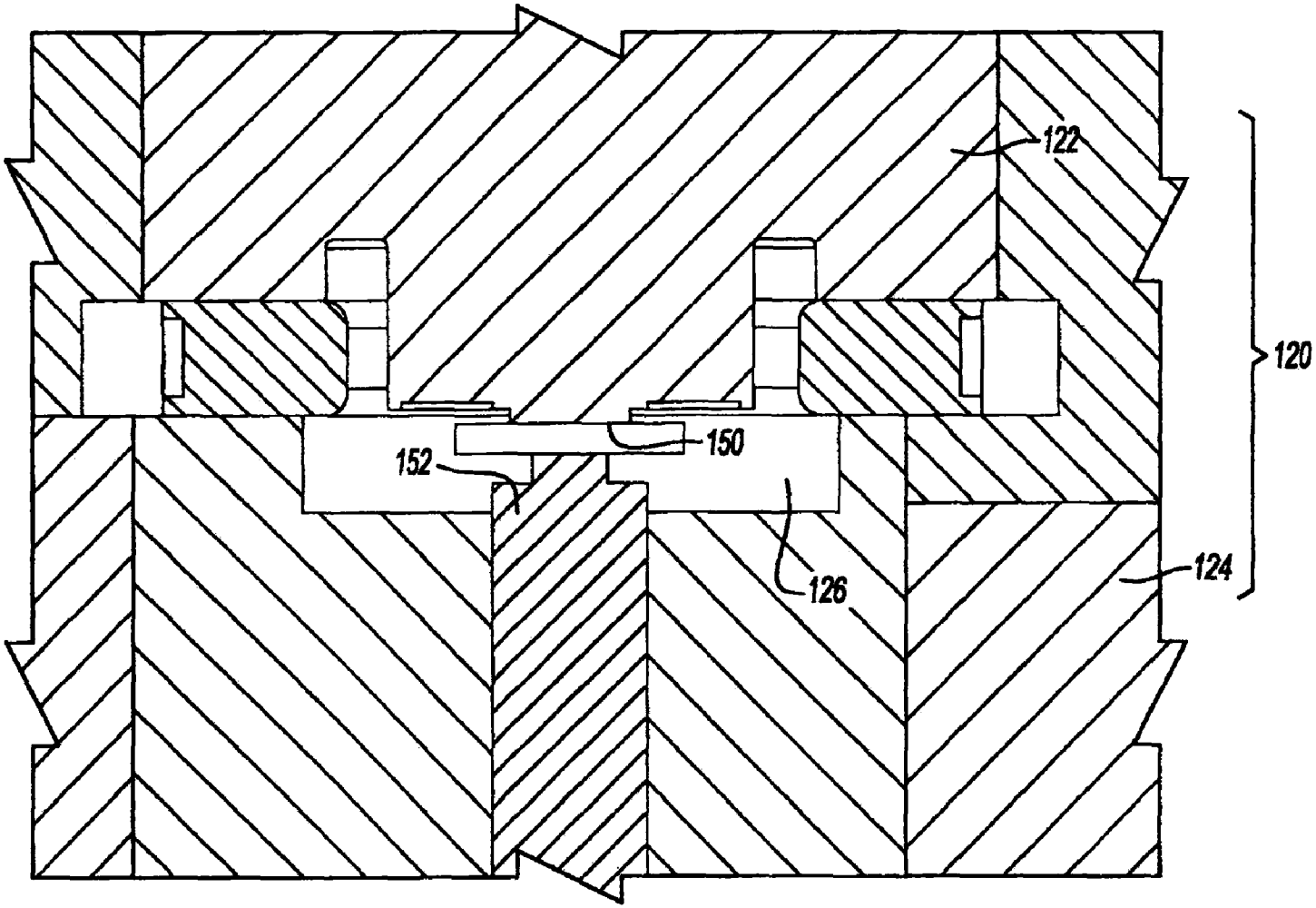
FIG. 8 is a sectional view similar to that of FIG. 7 but illustrating the lead frame and initiator chip as positioned in the mold cavity.

With reference to FIGS. 7 and 8, an exemplary mold 120 for forming the housing 16 (FIG. 1) and at least partially encapsulating the initiator chip 14 (FIG. 1) is illustrated. The mold 120 may include an upper mold portion 122 and a lower mold portion 124 that cooperate to define a mold cavity 126. The upper mold portion 122 may include components, such as slides, which may facilitate the formation of the attachment feature 72 (FIG. 1) in a manner that permits the housing 16 (FIG. 1) to be removed from the cavity 70, and/or core pins, which permit various portions of the mold cavity 126, such as the portion that defines the barrel 76 (FIG. 2) to be easily changed. Pins (not shown) or other locators may be employed to locate the lead frame 24 (FIG. 3) relative to the mold cavity 126. In the example provided, a round pin (not shown) and a diamond-shaped pin (not shown) extend through the locating apertures 40 (FIG. 3) in the lead frame 24 (FIG. 3) to partially locate the initiator chip 14 (FIG. 1) in the mold cavity 126.

In the example provided, the upper mold portion 122 includes a protrusion 150 that defines the barrel 76 (FIG. 2), while the lower mold portion 124 includes a positioning member 152 that is configured to position the initiator chip 14 (FIG. 2) against the protrusion 150. The positioning member 152 is movable relative to the mold cavity 126 and in the example provided, is biased upwardly toward the upper mold portion 122 by a spring 154.

With reference to FIG. 8, the lead frame 24 and initiator chip 14 may be loaded between the upper and lower mold portions 122 and 124 and the mold 120 may be closed. In this condition, the electrical contacts 12 may be clamped between the upper and lower mold portions 122 and 124 and the initiator chip 14 may be disposed in the mold cavity 126 and abutted against the protrusion 150 by the positioning member 152. Molten plastic may be injected into the mold cavity 126, thereby filling the void space in the mold cavity 126. Optionally, the positioning member 152 may be moved away from the initiator chip 14 while the plastic is being injected into the mold cavity 126 to thereby form the portion of the housing 16 (FIG. 1) that is located on a side of the initiator chip 14 opposite the protrusion 150.

From the foregoing, those of ordinary skill in the art will appreciate from this disclosure that the electrical contacts 12 may be clamped between the upper and lower mold portions 122 and 124 while the initiator chip 14 may be drive away from the base portions 30 of the electrical contacts 12 by the positioning member 152 or toward the base portions 30 of the electrical contacts 12 by the protrusion 150. The resilient nature of the spring arms 32 permits the initiator chip 14 to move relative to the base portions 30 and thereby reduces the risk that the electrical contacts 12 will separate from the first and second contacts 60 and 62 (FIG. 1) when the lead frame 24 and initiator chip 14 are loaded into the mold cavity 126. Moreover, that the positioning member 152 forces the initiator chip 14 toward the protrusion 150 (and also toward the first end 36 of the spring arms 32) improves the likelihood that the initiator 10 will be operable (i.e., electrically actuatable) in those situations where the connection between the electrical contacts 12 and one or both of the first and second contacts 60 and 62 fails.

Those of ordinary skill in the art will appreciate that the mold 120 and housing 16 (FIG. 1) may be configured somewhat differently. For example, the positioning member 152 may be configured to move as the upper and lower mold portions 122 and 124 are being closed and not move at any point during the injection of plastic into the mold cavity 126. When removed from the mold cavity 126, the housing 16 (FIG. 1) would include a hole (not shown) where the positioning member 152 had been located. In some situations, the presence of this hole is not detrimental and thus, cost savings may be realized through the simplification of the mold 120 in the initiator 10 (FIG. 1) through reduced consumption of plastic. Alternatively, the hole may be filled in a subsequent over-molding operation (i.e., such that the housing is loaded into another mold and plastic is injected into the hole to fill it) or with a suitable material, such as an epoxy. Where the hole is to be filled, the filling material (e.g., plastic, epoxy) may be colored to thereby visually indicate one or more characteristics of the initiator 10 (FIG. 1) or one or more portions thereof (e.g., the housing 16 (FIG. 1) and/or the initiator chip 14 (FIG. 1)).

Figure 9:
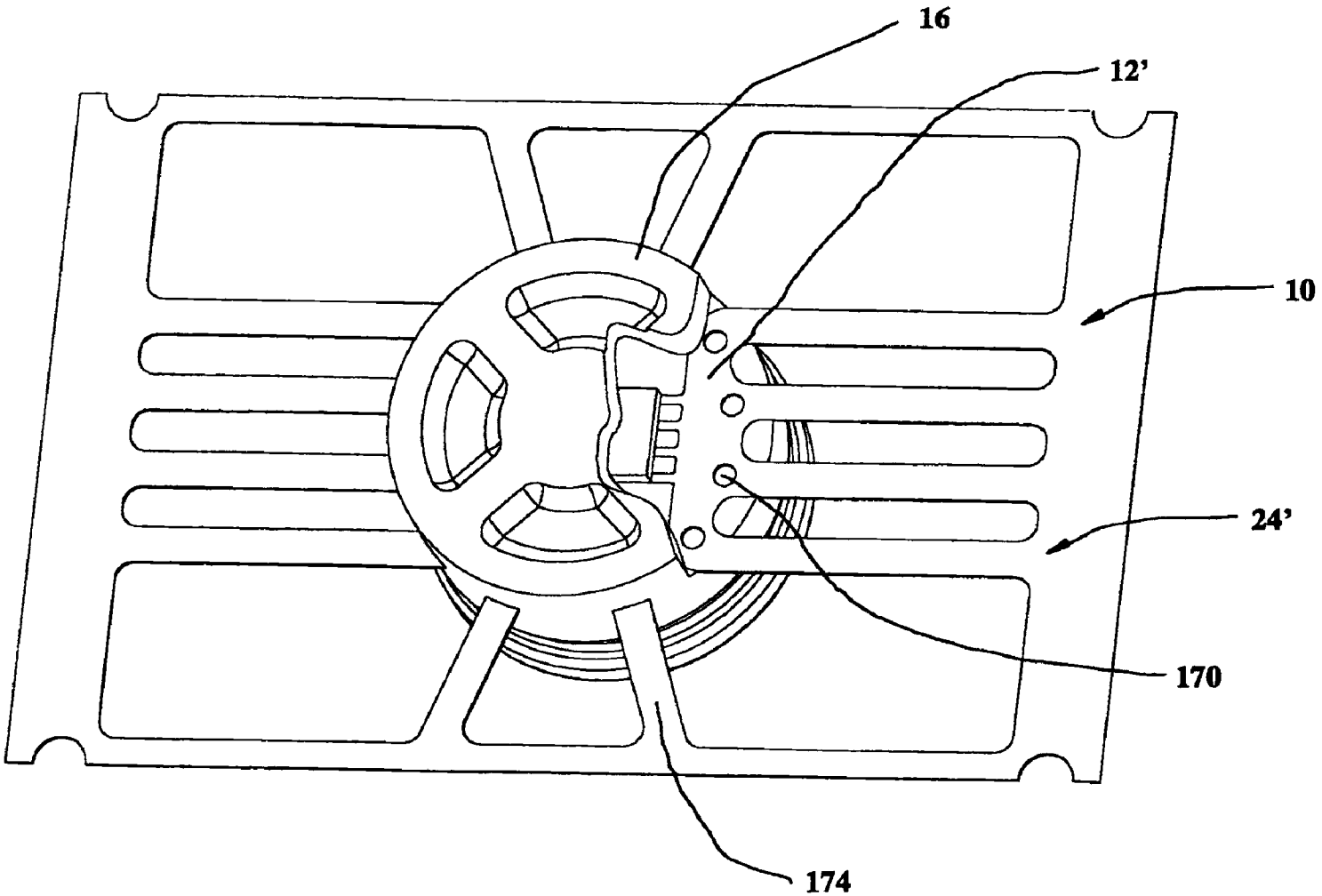
FIG. 9 is a partially broken-away perspective of another initiator constructed in accordance with the teachings of the present invention.

With reference to FIG. 9, the electrical contacts 12' may be formed with apertures 170 that permit the plastic material of the housing 16 to flow therethrough during the molding of the housing 16 and/or to further lock the electrical contacts 12' to the housing 16. The lead frame 24' may include one or more stabilization arms 174 that intersect and are partially encapsulated by the housing 16. The stabilization arms 174 may be provided to further stabilize the housing 16 relative to the lead frame 24' during the fabrication of the initiator 10.

Figure 10:
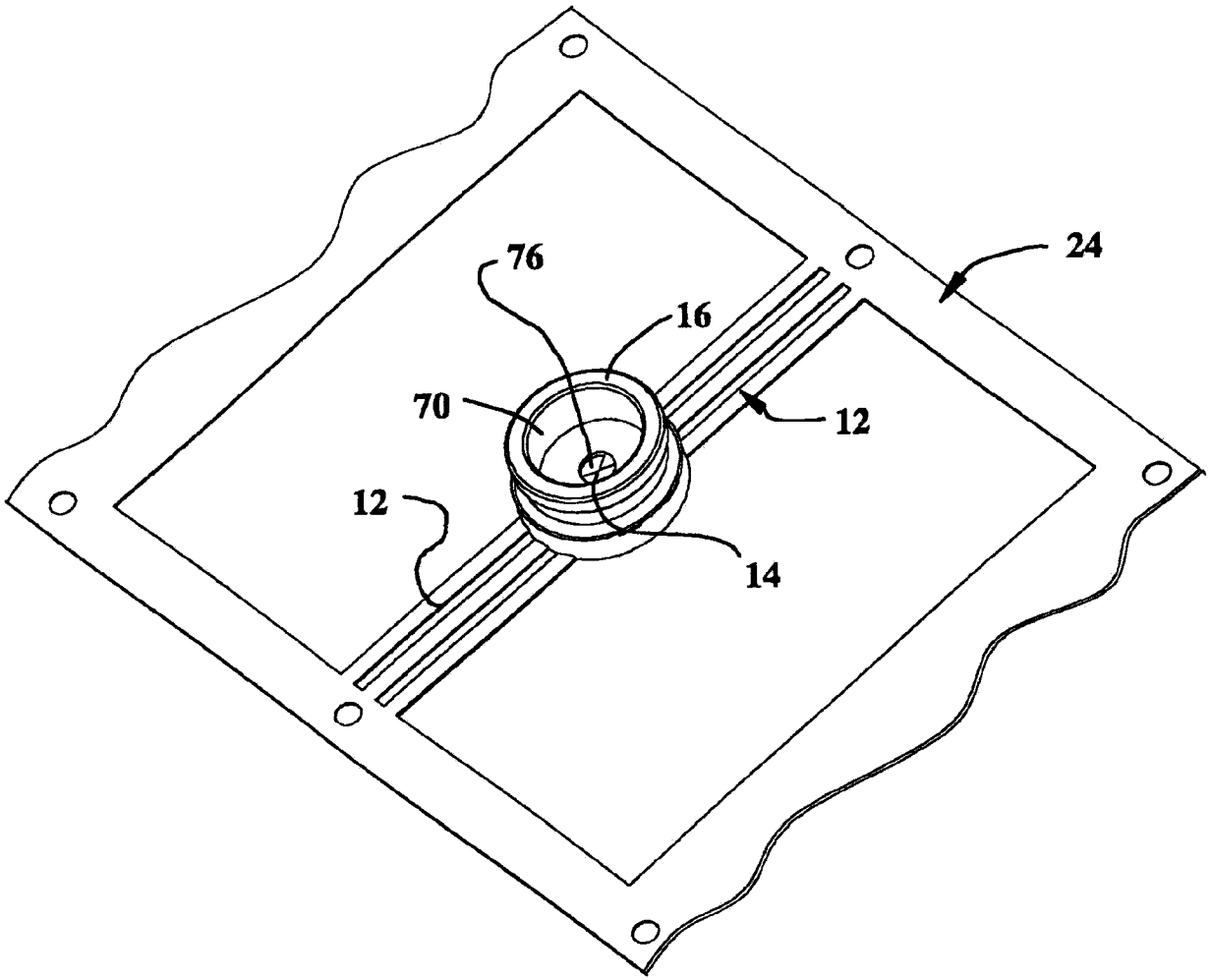
FIG. 10 is a perspective view of a portion of the initiator of FIG. 1 illustrating the housing as molded to the lead frame and the initiator chip.
Figure 11:
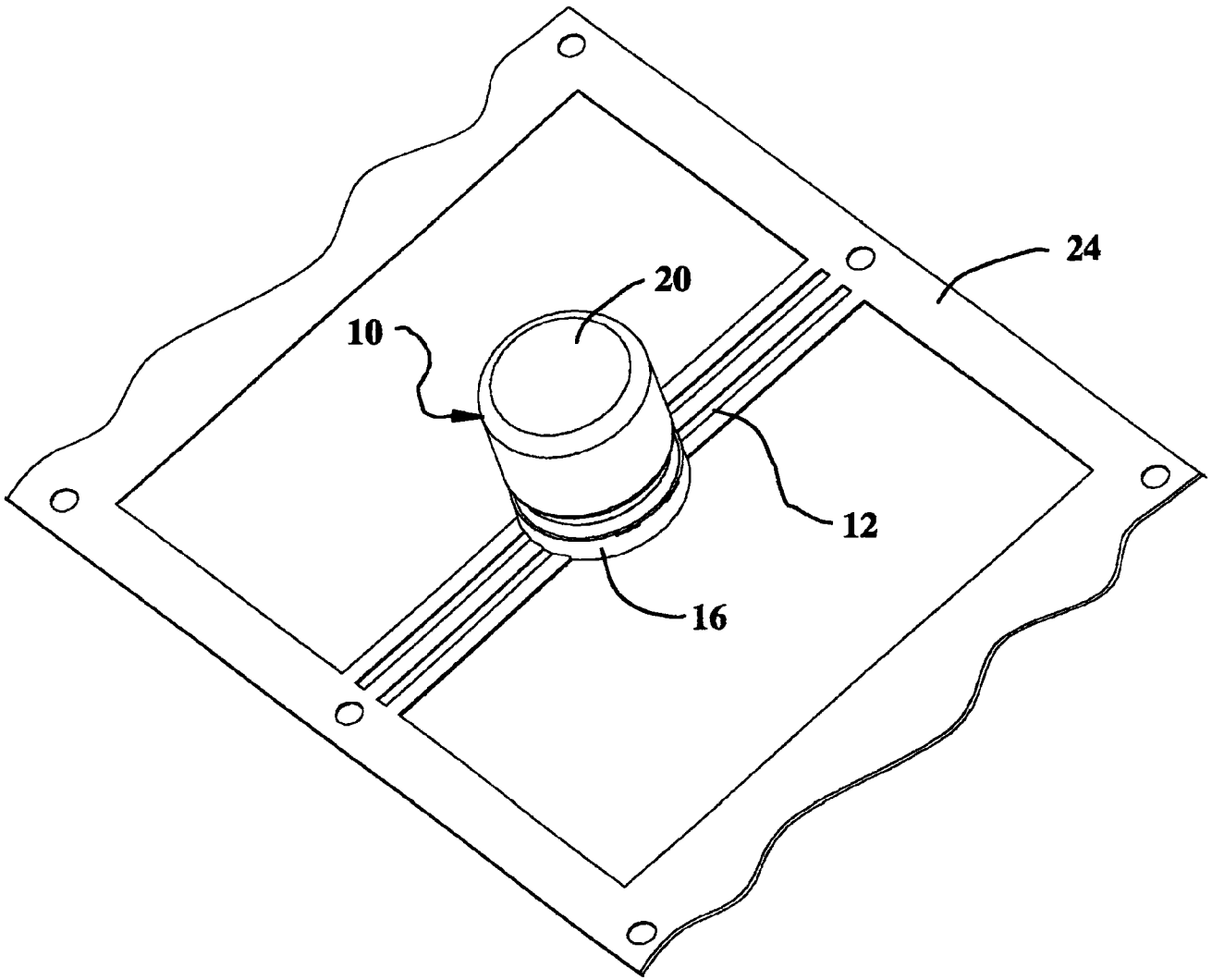
FIG. 11 is a perspective view of the initiator of FIG. 1 in an assembled condition and coupled to the frame portion of the lead frame.
Figure 12:
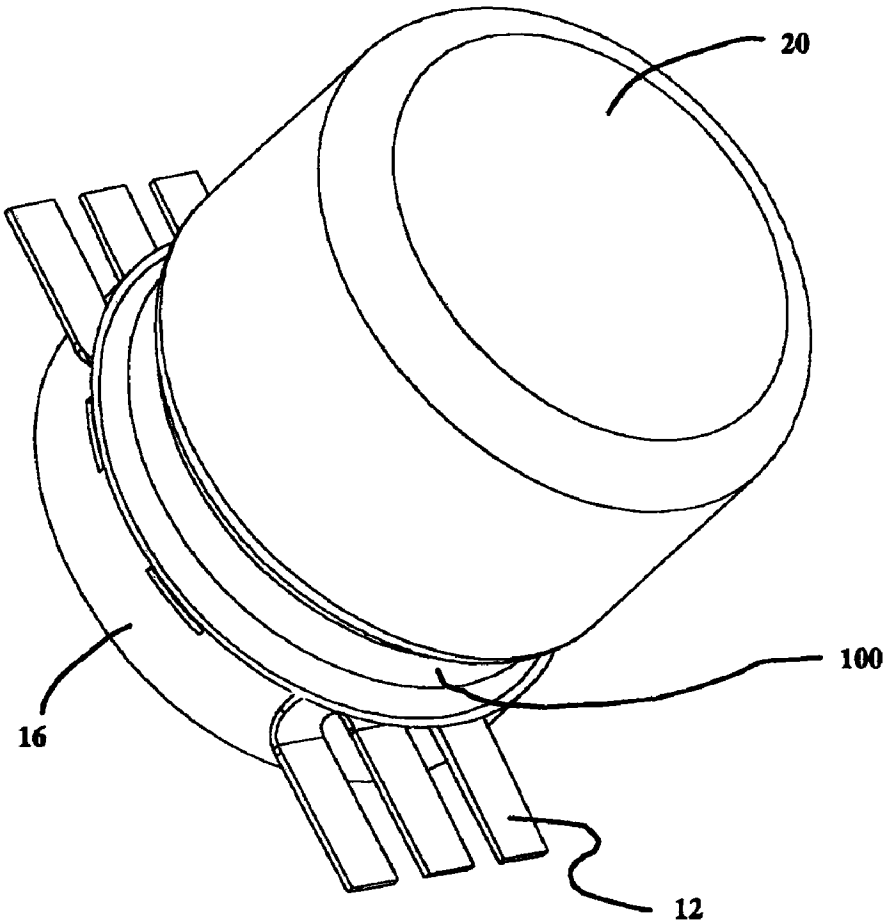
FIG. 12 is a perspective view of the initiator of FIG. 1.

FIG. 10 illustrates the housing 16 as encapsulating portions of the initiator chip 14 and the electrical contacts 12. The housing 16 may remain coupled to the lead frame 24 during one or more of the remaining initiator assembly steps, or may be immediately severed from the lead frame 24. In the example provided, the housing 16 remains joined to the lead frame 24 throughout the assembly process as is illustrated in FIG. 11, wherein the initiator 10 is illustrated in a completely assembled condition, and the initiator 10 is subsequently severed from the lead frame 24 as is shown in FIG. 12.

Figure 13:
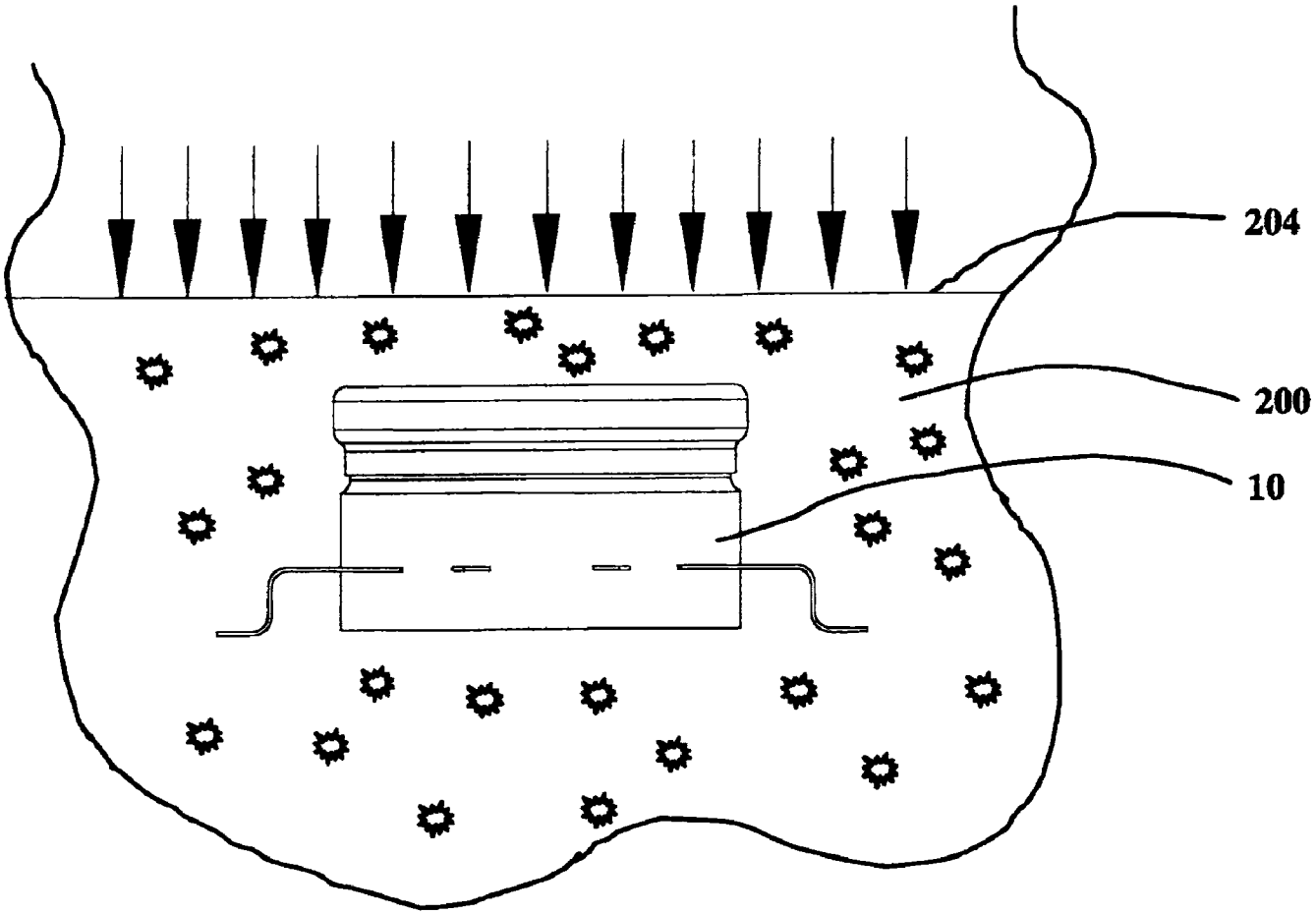
FIG. 13 is a schematic illustration of a detonation wave passing through a main charge in which an initiator constructed in accordance with the teachings of the present invention is disposed.
Figure 14:
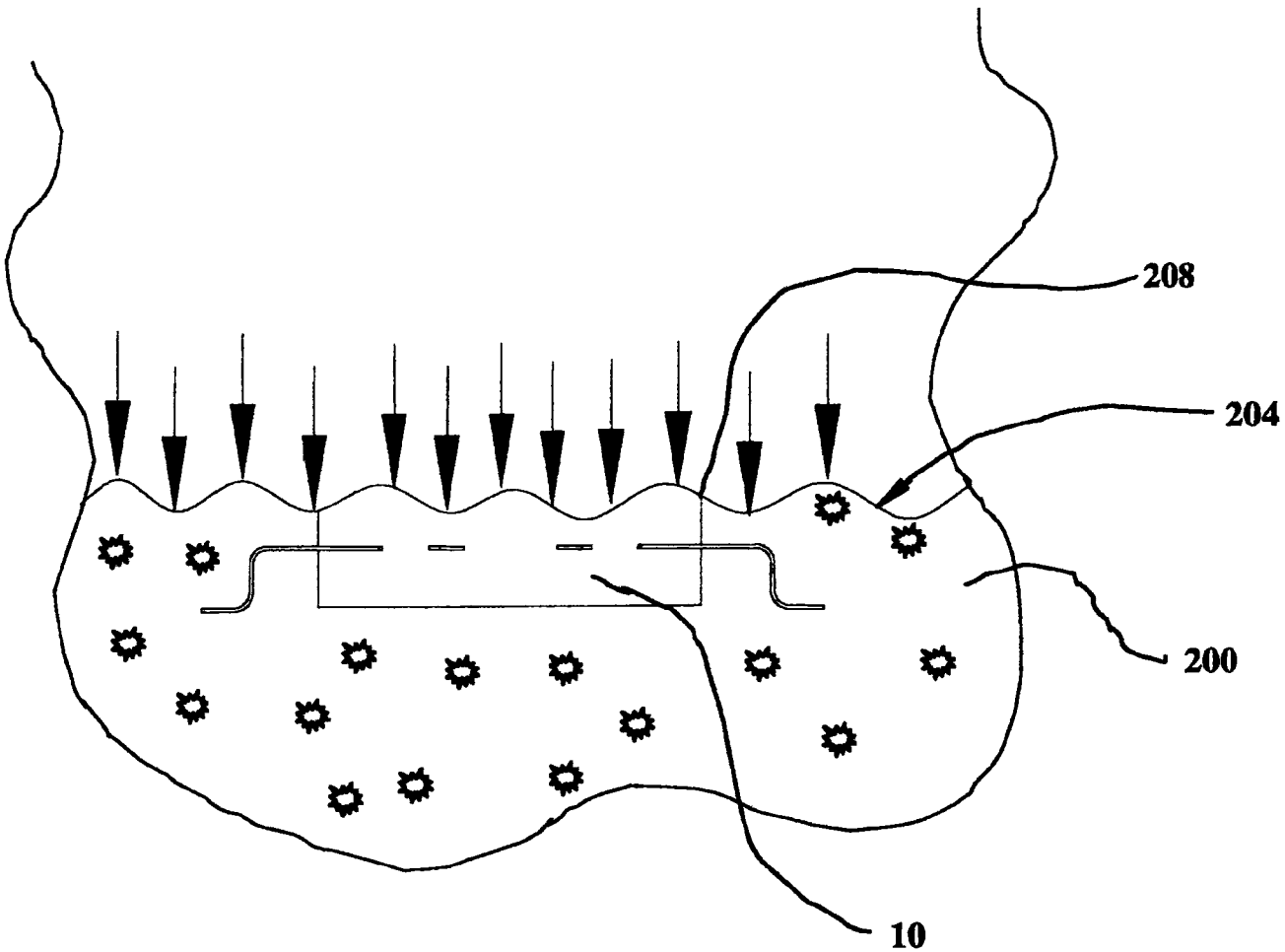
FIG. 14 is a schematic illustration that is similar to FIG. 13 but illustrating the detonation wave passing through the initiator.

With reference to FIGS. 13 and 14, the initiator 10 may be positioned in a main charge 200 of an explosive material. The main charge 200 may be formed of any suitable energetic material, such as PBXN-5, PBXN-7, PBXN-11, CH-6, PAX-41, PBXN-9, C-4, RDX, AFX-221, PBXN-110, PBXN-112, COMPB, and/or OCTOL for example. The initiator 10 may be disposed within the main charge 200 such that the material that forms the main charge 200 is uniformly distributed about the initiator 10 (i.e., without voids). Pressed plastic explosives and cast charges (e.g., melt-pour) are particularly well suited, but those of ordinary skill in the art will appreciate that other materials and techniques may also be employed. A detonation wave 204, which may be generated via the detonation of another energetic material (not shown), is illustrated to be traveling through the main charge 200 and the initiator 10. As the detonation wave 204 travels through the initiator 10, the different materials that make up the initiator 10, along with the geometry of the components of the initiator 10 and the direction from which the detonation wave 204 approaches the initiator 10 affect the detonation wave 204, causing discrete areas of the detonation wave 204 to become non-planar. The configuration of the initiator 10 greatly minimizes the non-planar perturbations 208 in the detonation wave 204 through the use of a housing 16 with a density that approximates the density of the main charge 200 and reduced use of relatively dense materials, such as ceramics and stainless steels. Accordingly, the detonation wave 204 may pass through the initiator 10 with perturbations 208 that are relatively fewer in number and lower in amplitude as compared with prior art initiators.

Figure 15:
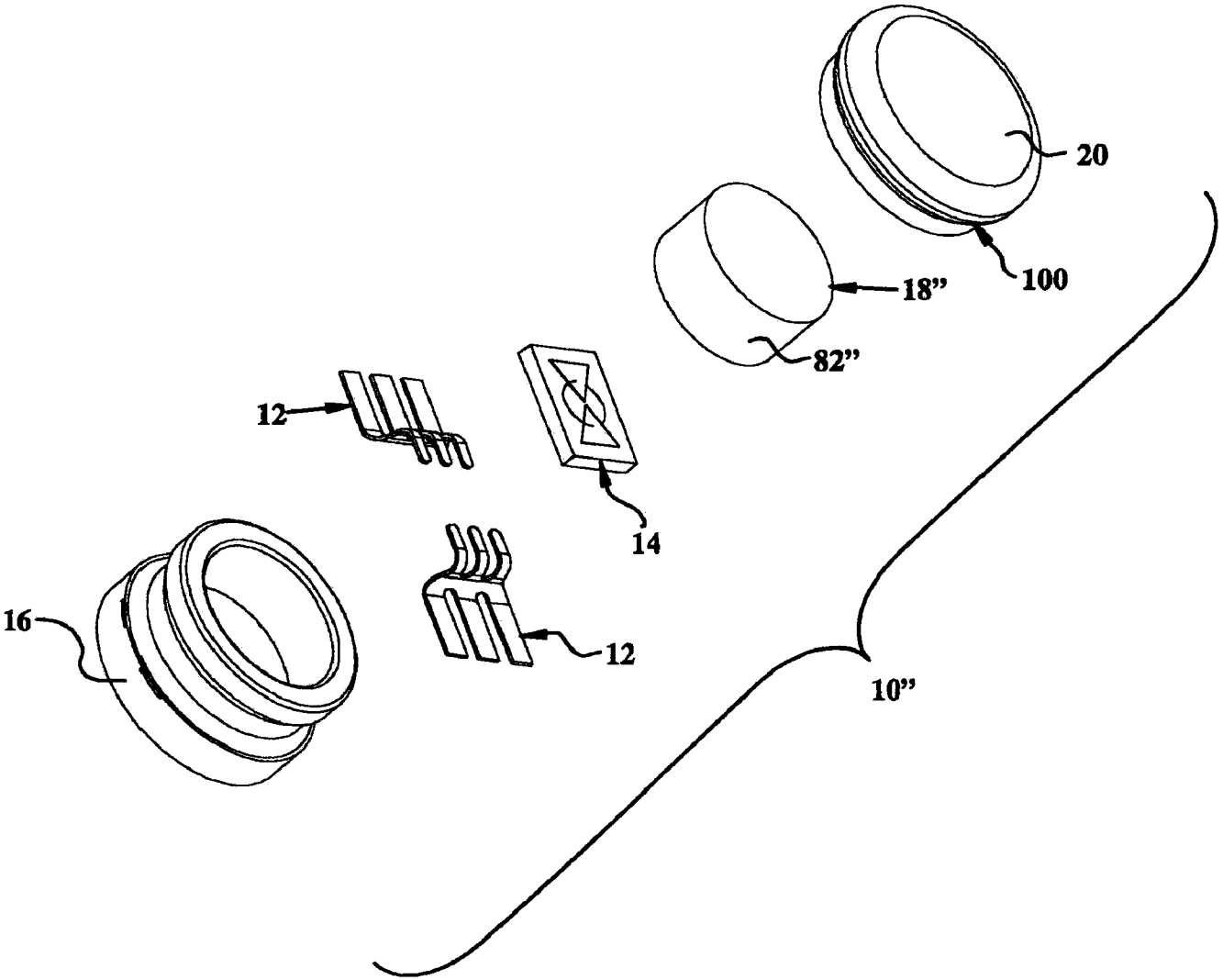
FIG. 15 is an exploded perspective view of another initiator constructed in accordance with the teachings of the present invention.
Figure 16:
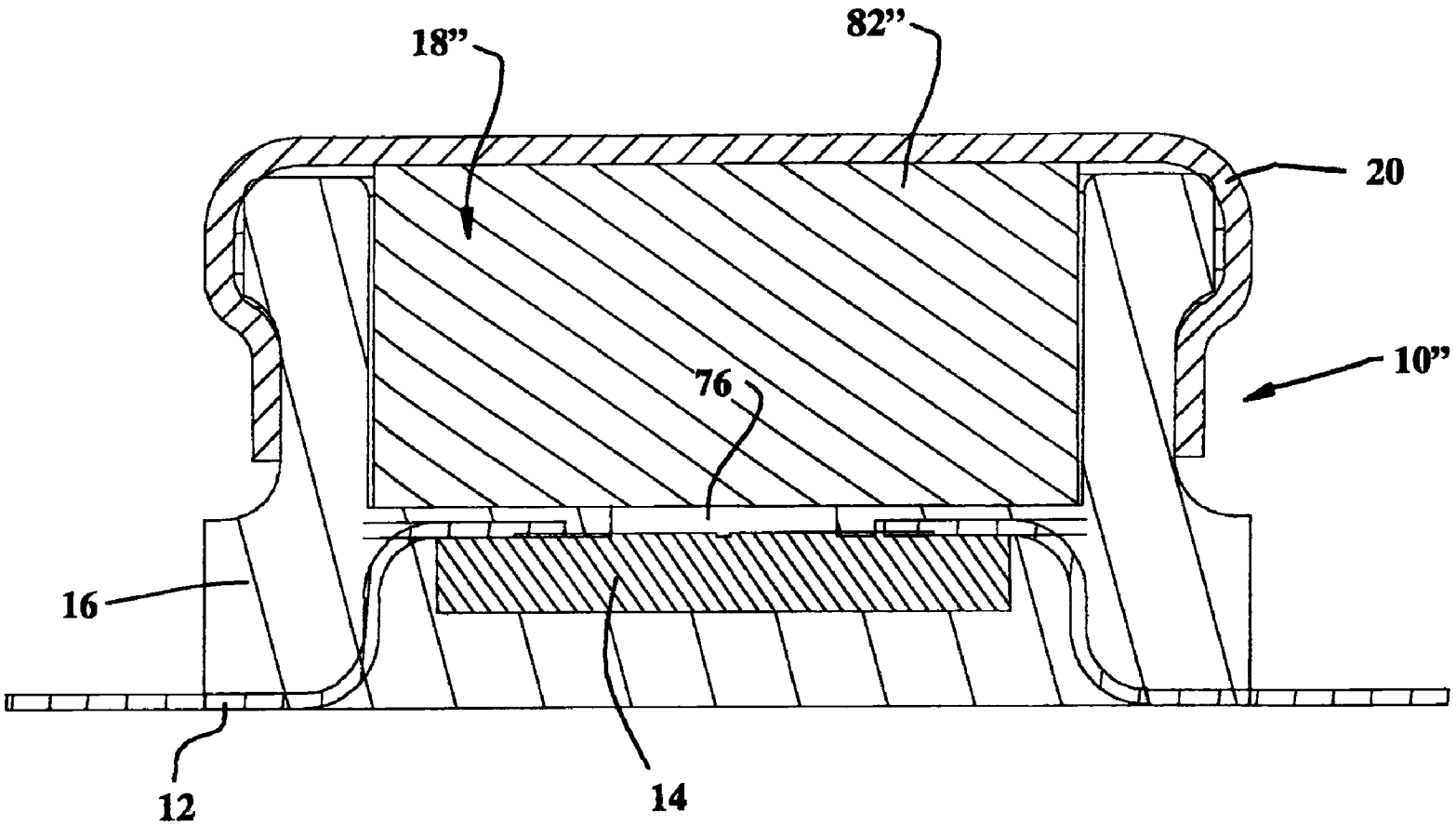
FIG. 16 is a longitudinal section view of the initiator of FIG. 15.

While the initiator 10 has been described thus far as including a pellet assembly 18 that includes two pellets of energetic material, those skilled in the art will appreciate that the invention, in its broader aspects, may be constructed somewhat differently. For example, the initiator may include a pellet assembly with a single pellet of energetic material as shown in FIGS. 15 and 16. In this arrangement, the initiator 10" includes a pellet assembly 18" that is comprised of a single pellet 82" of energetic material, such as RSI-007. As the structural sleeve 80 (FIG. 5) and second pellet 84 (FIG. 5) are not employed in this embodiment, the first and second members 90 and 92 (FIG. 5) may be omitted. Consequently, the initiator 10" may be less costly to fabricate than the initiator 10 of FIG. 1 or 5.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An initiator comprising:

a housing formed of plastic, the housing defining an aperture that is adapted to receive an energetic material; and a chip assembly that is adapted to initiate at least one of a combustion event, a deflagration event and a detonation event in the energetic material, the chip assembly including an electrically-actuated chip and a pair of electric leads that are electrically coupled to the electrically-actuated chip, the electric leads extending through the housing and being adapted to couple the electrically-actuated chip to a fireset circuit, the electrically-actuated chip being partially encapsulated in the housing and extending into the aperture in the housing.

2. The initiator of claim 1 wherein the electrically-actuated chip includes at least one of an exploding bridge wire initiator, a squib, and a semi-conductor bridge device.

3. The initiator of claim 2 wherein the electronically-actuated chip includes an exploding foil initiator.

4. The initiator of claim 3 wherein the housing at least partially defines a barrel of the exploding foil initiator.

5. The initiator of claim 3 wherein at least one of the electric leads includes one or more deflectable arm members that abut an associated terminal on the electrically-actuated chip.

6. The initiator of claim 5 wherein at least a portion of the one or more deflectable arm members are soldered to the associated terminal.

7. The initiator of claim 6 wherein at least a portion of the one or more deflectable arm members are encapsulated in the plastic that forms the housing.

8. The initiator of claim 1 wherein each of the electric leads comprises a plurality of spring arms that are electrically coupled to a corresponding contact on the electrically-actuated chip so that electrical contact between each electric lead and its associated electrical contact is made at a plurality of discrete points.

9. The initiator of claim 1, further comprising a sleeve received into the aperture, the sleeve being adapted to surround and structurally support the energetic material.

10. An initiator comprising:

a housing formed of plastic, the housing defining an aperture that is adapted to receive an energetic material; and an exploding foil initiator having a bridge and a pair of contacts that are adapted to cooperate in transmitting electrical energy across the bridge, a portion of the exploding foil initiator radially outwardly of the bridge being encapsulated in the plastic that forms the housing; and a plurality of electric leads coupled to the contacts.

11. The initiator of claim 10 wherein the contacts are encapsulated in the plastic that forms the housing.

12. The initiator of claim 11 wherein at least a portion of the electric leads are encapsulated in the plastic that forms the housing.

13. The initiator of claim 12 wherein the plastic that forms the housing also forms a portion of the exploding foil initiator.

14. The initiator of claim 13 wherein the portion of the exploding foil initiator comprises a barrel.

15. The initiator of claim 10, further comprising an initiation charge formed of an explosive material, the initiation charge being received in the aperture and positioned to receive energy released by the exploding foil initiator to initiate a detonation event in the initiation charge.

16. The initiator of claim 15 wherein the explosive material is a secondary explosive.

17. The initiator of claim 15, further comprising a reinforcing ring received in the aperture and disposed between the housing and the initiation charge.

18. The initiator of claim 17 wherein the reinforcing ring is formed of a conductive material and is disposed axially in-line with at least one of the electric leads, at least one of the contacts, or at least one of the electric leads and at least one of the contacts, and wherein the plastic that forms the housing electrically insulates the reinforcing ring from the contacts and the electric leads.

19. An initiator comprising:

a housing formed of plastic, the housing defining an aperture that is adapted to receive an energetic material; and an exploding foil initiator having a bridge and a pair of contacts that are adapted to cooperate in transmitting electrical energy across the bridge, a portion of the exploding foil initiator radially outwardly of the bridge being encapsulated in the plastic that forms the housing, the contacts are encapsulated in the plastic that forms the housing;

a plurality of electric leads coupled to the contacts, at least a portion of the electric leads are encapsulated in the plastic that forms the housing;

an initiation charge formed of a secondary explosive, the initiation charge being received in the aperture and positioned to receive energy released by the exploding foil initiator to initiate a detonation event in the initiation charge; and a reinforcing ring received in the aperture and disposed between the housing and the initiation charge, the reinforcing ring being formed of a conductive material and is disposed axially in-line with at least one of the electric leads, at least one of the contacts, or at least one of the electric leads and at least one of the contacts, and wherein the plastic that forms the housing electrically insulates the reinforcing ring from the contacts and the electric leads.

20. The initiator of claim 19 wherein the plastic that forms the housing also forms a barrel of the exploding foil initiator.

* * * * *